US007354300B2

(12) United States Patent
Shindo

(10) Patent No.: US 7,354,300 B2
(45) Date of Patent: Apr. 8, 2008

(54) CONNECTOR

(75) Inventor: Hidehiro Shindo, Kawasaki (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 9 days.

(21) Appl. No.: 10/595,540

(22) PCT Filed: Sep. 14, 2004

(86) PCT No.: PCT/JP2004/013355

§ 371 (c)(1),
(2), (4) Date: Apr. 27, 2006

(87) PCT Pub. No.: WO2005/090285

PCT Pub. Date: Sep. 29, 2005

(65) Prior Publication Data

US 2007/0066142 A1 Mar. 22, 2007

(30) Foreign Application Priority Data

May 7, 2004 (JP) ..... 2004-138567

(51) Int. Cl.
*H01R 9/05* (2006.01)

(52) U.S. Cl. ..... 439/497; 439/579; 439/607

(58) Field of Classification Search ..... 439/497, 439/499, 495, 579, 607, 610
See application file for complete search history.

(56) References Cited

U.S. PATENT DOCUMENTS 5,470,238 A * 11/1995 Walden ..... 439/98
5,658,164 A * 8/1997 Parker ..... 439/495
6,338,652 B1 * 1/2002 Ko ..... 439/579
6,475,024 B1 * 11/2002 Narui ..... 439/495
6,676,444 B2 * 1/2004 Noro ..... 439/579
6,830,478 B1 * 12/2004 Ko ..... 439/579
6,863,559 B2 * 3/2005 Yu ..... 439/497
6,981,891 B1 * 1/2006 Huang ..... 439/497

FOREIGN PATENT DOCUMENTS

| | | |
|---|---|---|
| JP | 4-115772 | 10/1992 |
| JP | 09-232039 | 9/1997 |
| JP | 09-289061 | 11/1997 |
| JP | 2001-035612 | 2/2001 |
| JP | 2003-272774 | 9/2003 |

* cited by examiner

*Primary Examiner*—Hien Vu
(74) *Attorney, Agent, or Firm*—Lowe Hauptman Ham & Berner LLP

(57) ABSTRACT

A connector which is capable of reliably shielding a connection subject article inserted in a housing from electromagnetic waves and which can be easily produced in two types, one for inserting a connection subject article in one vertical direction and the other for inserting it in another direction. Since a ground shell (30) is formed to cover the upper and lower surfaces and opposite side surfaces of a housing (10), a cable (1) in the housing (10) can be electrically shielded in any of the directions of the upper surface, lower surface and opposite side surfaces of the housing (10), thus greatly improving the electromagnetic interference prevention effect. In this case, since the upper surface and lower surface of the shell (30) are disposed on the upper surface and lower surface of the housing (10), respectively, a ground contact (31) can be placed on the upper surface rather than on the lower surface of the shell (30). For example, one type for inserting the cable (1) in one vertical direction and another type for inserting it in another direction can be easily produced.

3 Claims, 6 Drawing Sheets

CONNECTOR

RELATED APPLICATIONS

The present application is a filing under Sections 371 of International Application Number PCT/JP04/013355 filed Sep. 14, 2004 which is based on, and claims priority from Japanese Application Number 2004-138567, filed May 2, 2004, the disclosures of which are hereby incorporated in their entirety.

TECHNICAL FIELD

The present invention relates to a connector which connects an object to be connected, such as a flexible flat cable (FFC) or a flexible printed circuit (FPC) for example, to a circuit board.

BACKGROUND ART

As a connector of this type there has hitherto been known a connector which is constituted by multiple signal-time terminals which are spaced laterally from each other, an insulative housing which holds each of the terminals, and a metal shell which covers the top surface and right and left side surfaces of the housing and in which the shell is connected to a grounding portion of a circuit board (refer to Patent Document 1, for example). an object to be connected which is connected to this connector, is provided with multiple signal-line conductive portions which are spaced laterally from each other on one surface of an insulative cable main body formed in the shape of a sheet and also provided with a metal reinforcing plate through a grounding conductive layer on the other surface of the cable main body, and a grounding conductive portion is formed by the reinforcing plate.

In the above-described connection, when the object to be connected is inserted from the side of one end, each of the terminals comes into contact with each of the signal-line conductive portions of the object to be connected from below and the grounding conductive portion of the object to be connected comes into contact with the top surface side of the shell, whereby each of the signal-line conductive portions of the object to be connected and the grounding conductive portion are respectively electrically connected to the circuit board.

However, the above-described connector is formed in such a manner that the shell covers only the top surface and two right and left side surfaces of the housing and, therefore, this posed the problem that the bottom surface side of the housing cannot be electrically shielded, resulting in insufficient measures against EMI (electromagnetic interference). Furthermore, because the shell of the above-described connector has no portion corresponding to the bottom surface side of the housing, this posed the problem that the grounding conductive portion can be provided only on the top surface side of the shell, with the result that it is impossible to construct the connector in such a manner that an object to be connected is inserted, with the grounding conductive portion facing downward.

[Patent Document 1] Japanese Patent Publication 2003-272774

DISCLOSURE OF THE INVENTION

The present invention has been made in view of the above problems and the object of the invention is to provide a connector which can positively shield an object to be connected, which has been inserted into a housing, from electromagnetic waves and can be easily manufactured as both a type in which the object to be connected can be inserted with the top surface side up and a type in which the object to be connected can be inserted with the bottom surface side up.

To achieve the above object, the present invention provides a connector which comprises multiple signal-line terminals spaced laterally from each other, an insulative housing holding each of the terminals, and a metal shell covering the housing and which connects multiple signal-line conductive portions provided on one surface of an object to be connected to each of the terminals and connects a grounding conductive portion provided on the other surface of the object to be connected to the shell, characterized in that the shell is formed so as to cover a top surface, a bottom surface and two side surfaces of the housing and there is provided a grounding contact portion which comes into contact with the grounding conductive portion of the object to be connected on the top-surface side or the bottom-surface side of the shell.

As a result of this, because the top surface, bottom surface and two side surfaces of the housing are covered with the shell, the object to be connected present within the housing is electrically shielded in any direction of the top surface, bottom surface and two side surfaces of the housing.

According to a connector of the present invention, because an object to be connected within the housing can be electrically shielded in any direction of the top surface, bottom surface and two side surfaces of the housing, it is possible to significantly improve the effect of preventing electromagnetic interference and the connector is very advantageous for the connection to, for example, an FFC or an FPC having a microstrip line structure.

BRIEFLY DESCRIBE OF THE DRAWINGS

BEST MODE FOR CARRYING OUT THE INVENTION

Figure 1:
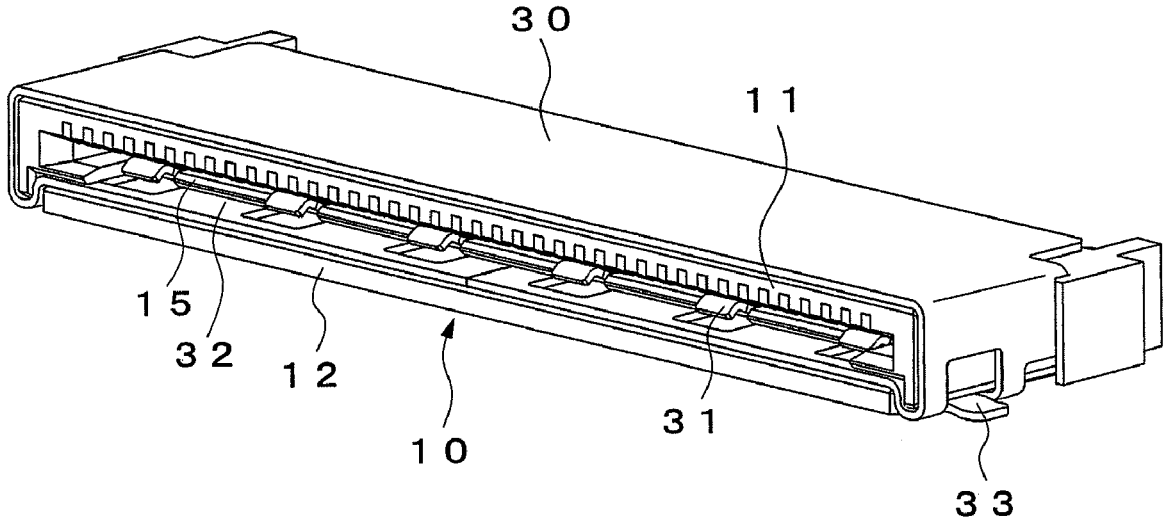
FIG. 1 is a perspective view of the front side of the connector in one preferred embodiment of the present invention.
Figure 2:
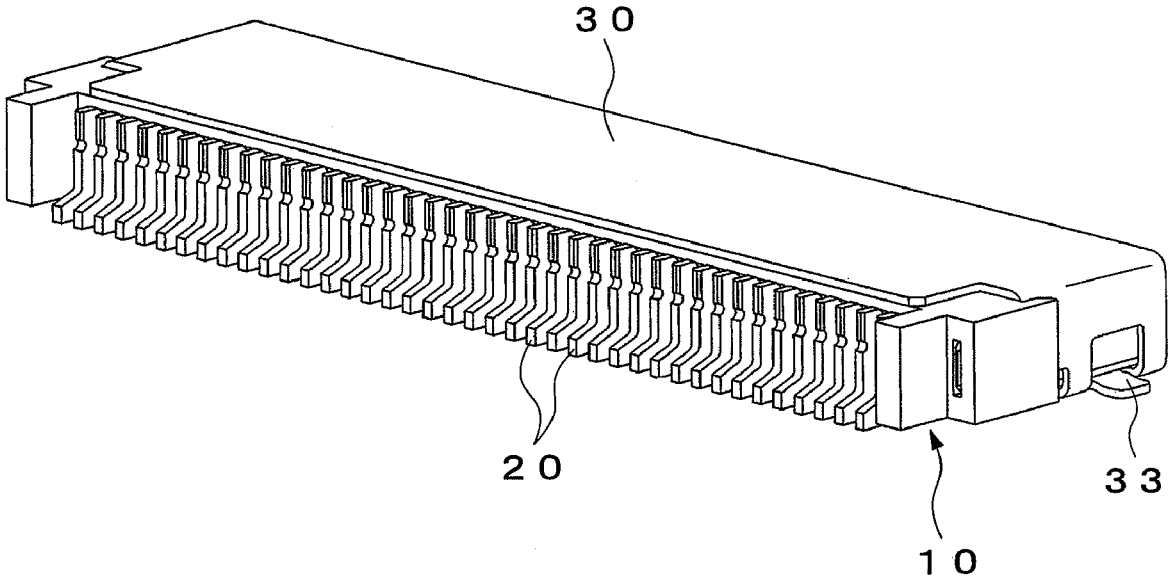
FIG. 2 is a perspective view of the back side of the connector.
Figure 3:
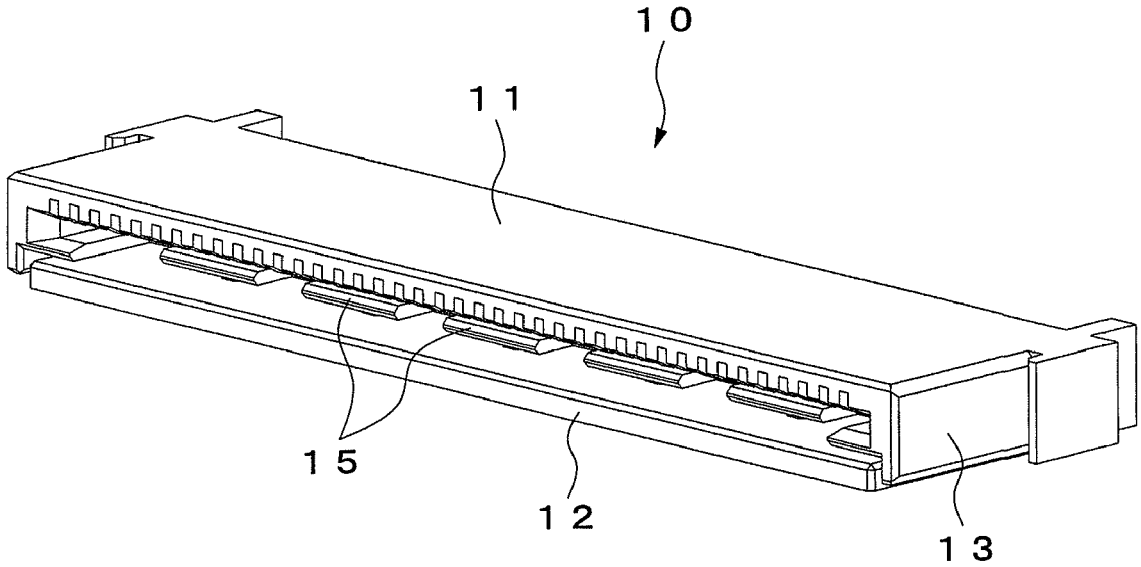
FIG. 3 is a perspective view of the front side of a housing.
Figure 4:
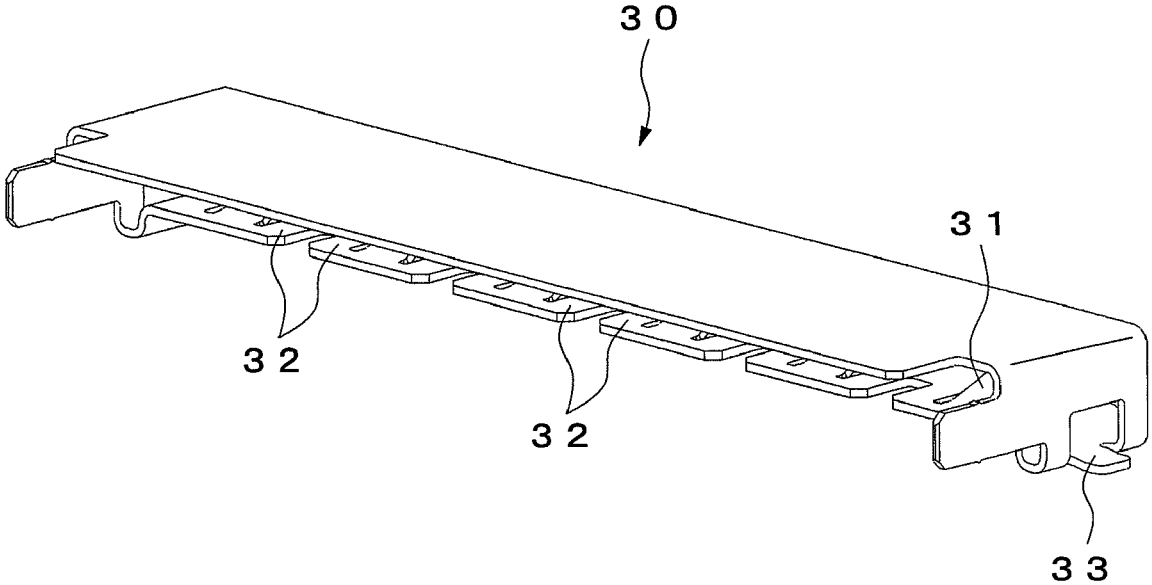
FIG. 4 is a perspective view of the back side of a shell.
Figure 5:
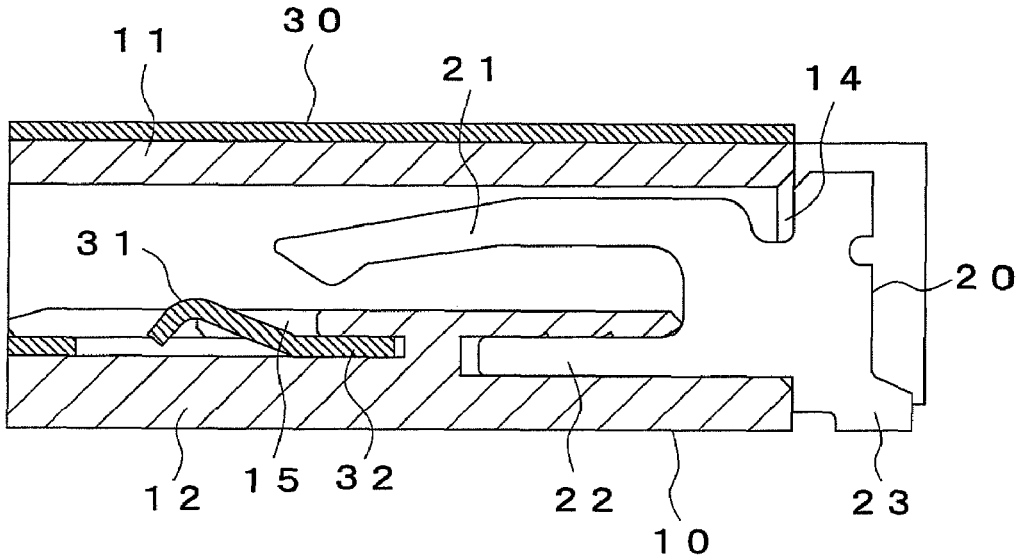
FIG. 5 is a sectional side view of the connector.
Figure 6:
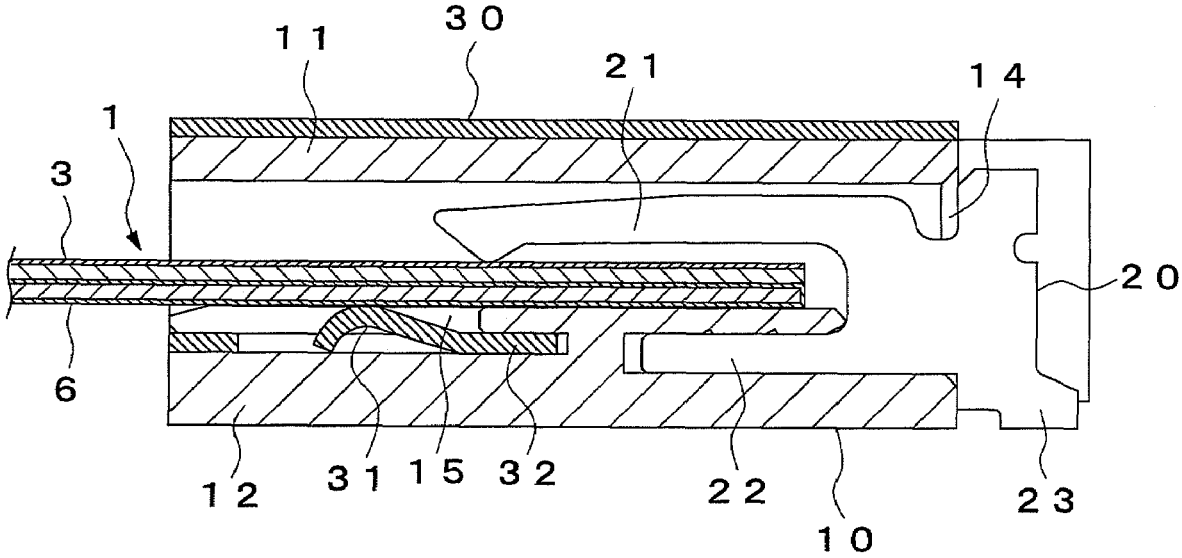
FIG. 6 is a sectional side view of the connector into which a cable is inserted.
Figure 7:
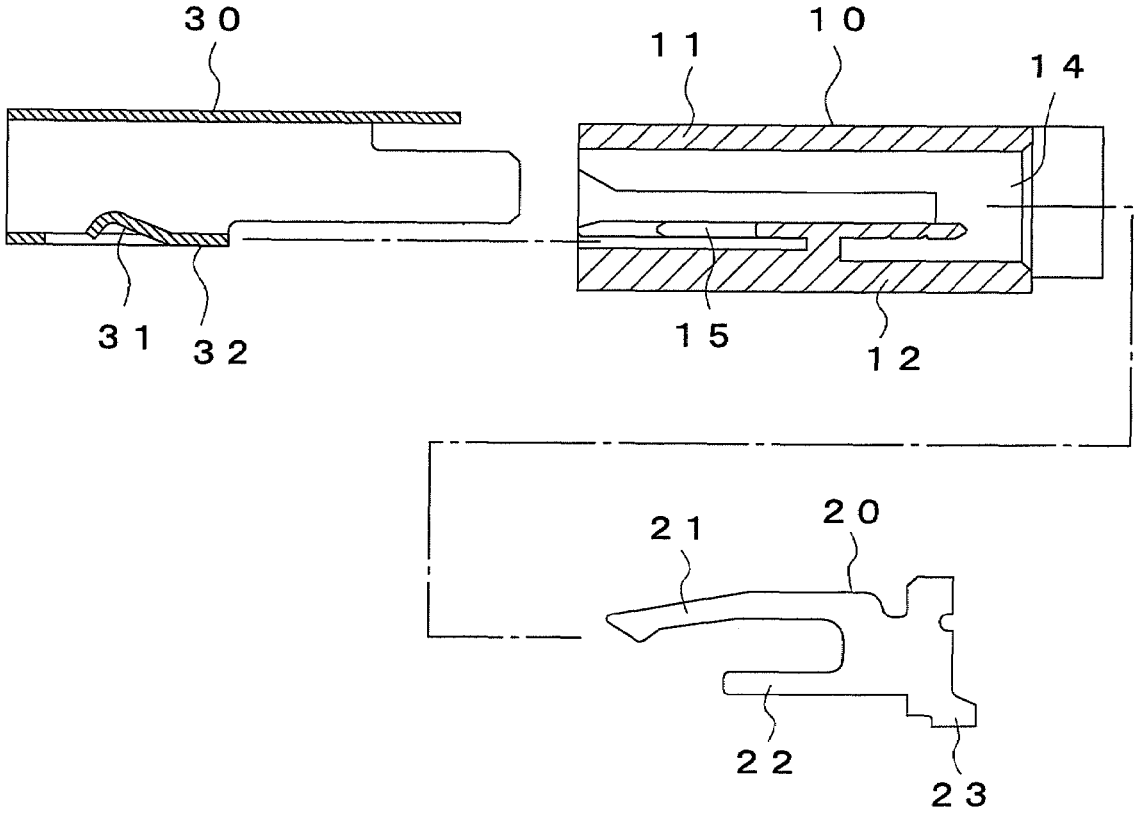
FIG. 7 is an exploded sectional side view of the connector.
Figure 8:
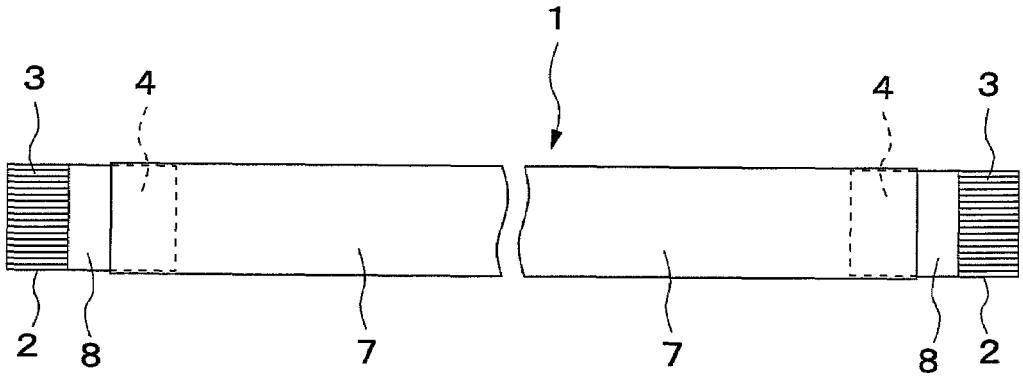
FIG. 8 is a plan view of a flexible flat cable.
Figure 9:
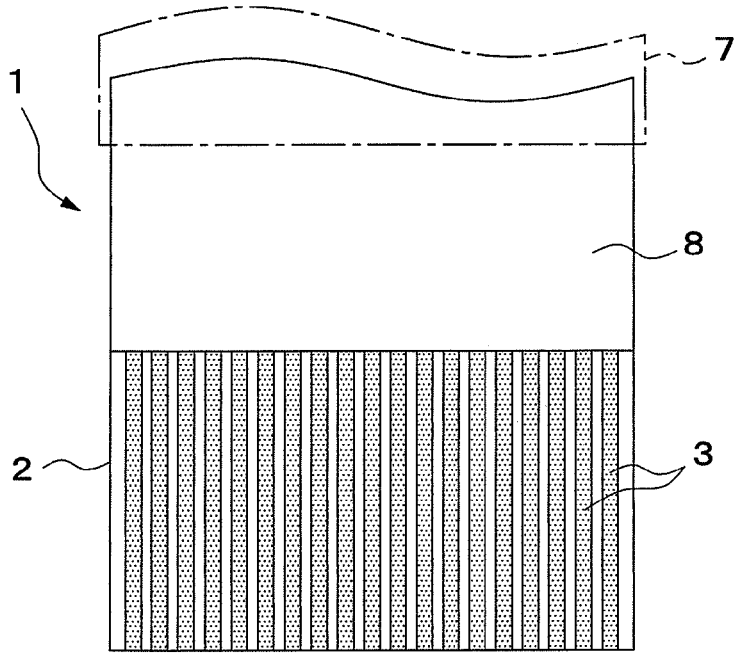
FIG. 9 is a partial view that shows the side of one surface of the flexible flat cable.
Figure 10:
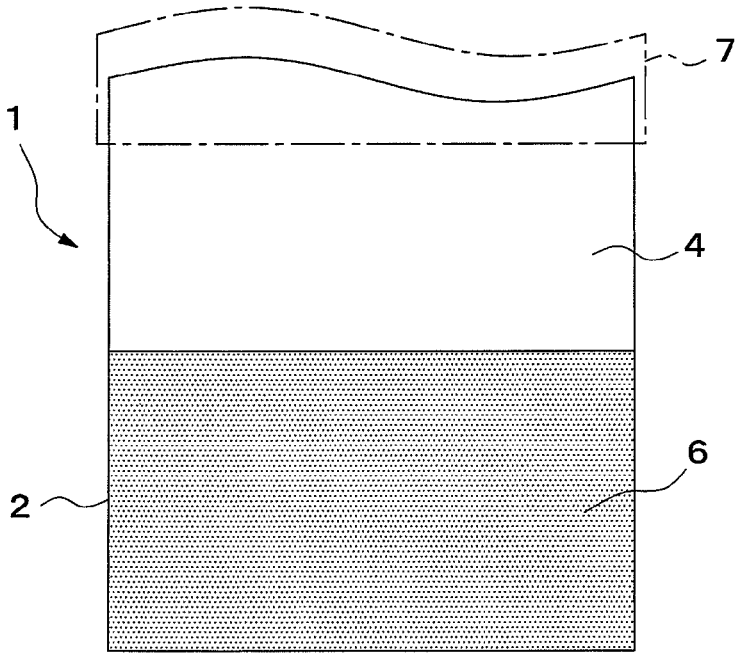
FIG. 10 is a partial plan view that shows the side of other surface of the flexible flat cable.
Figure 11:
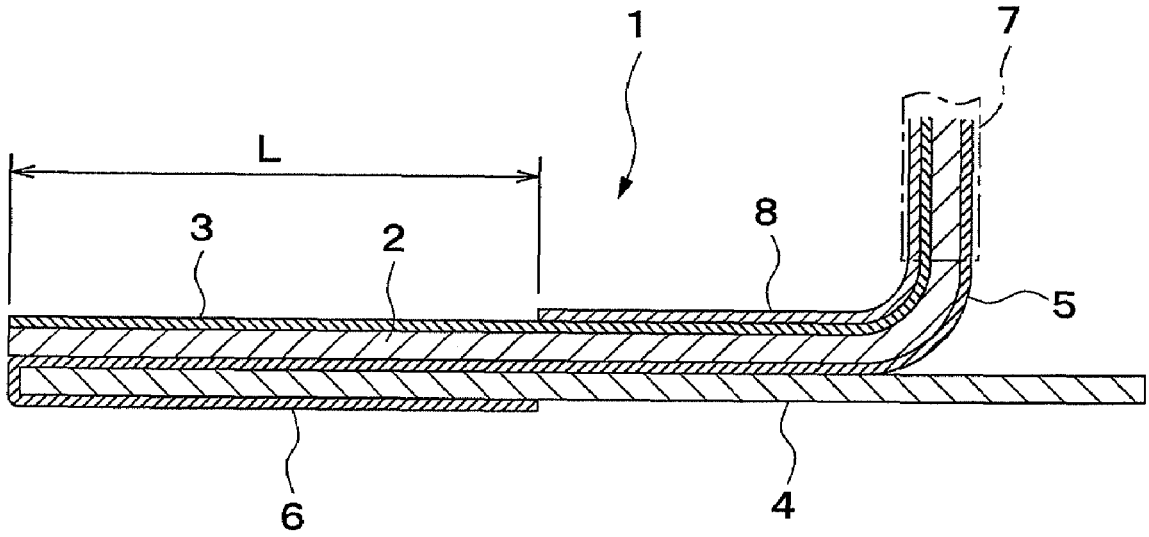
FIG. 11 is a sectional side view of the flexible flat cable.

FIG. 1 to FIG. 11 are diagram of one preferred embodiment of the present invention. FIG. 1 is a perspective view of the front side of a connector. FIG. 2 is a perspective view of the back side of the connector. FIG. 3 is a perspective view of the front side of a housing. FIG. 4 is a perspective view of the back side of a shell. FIG. 5 is a sectional side view of the connector. FIG. 6 is a sectional side view of the connector into which a cable is inserted. FIG. 7 is an exploded sectional side view of the connector. FIG. 8 is a plan view of a flexible flat cable. FIG. 9 is a partial plan view that shows the side of one surface of the flexible flat cable. FIG. 10 is a partial plan view that shows the side of the other surface of the flexible flat cable. FIG. 11 is a sectional side view of the flexible flat cable.

This connector is constituted by a housing 10 into which the side of one end of a flexible flat cable 1 (FIGS. 8-11) (hereinafter referred to as a cable 1) as an object to be connected can be inserted, multiple terminals 20 (FIG. 2) which are spaced laterally from each other within the housing 10, and a shell 30 which covers the housing.

The cable 1 is constituted by an insulative cable main body 2 which is formed in the shape of a sheet, multiple signal-line conductive portions 3 which are spaced laterally from each other on one surface of the cable main body 2, a reinforcing plate 4 which is disposed on the other surface of the cable main body 2, a conductor 5 in the form of a sheet disposed between the reinforcing plate 4 and the cable main body 2, a grounding conductive portion 6 provided on one surface of the reinforcing plate 4, a shielding member 7 which covers the cable main body 2 except end portions thereof, and an insulating cover 8 which covers the part of each of the signal-line conductive portions 3 except a prescribed length L from the leading end side thereof. In this case, the side of one end of the conductor 5 is folded back to the side of the other surface of the reinforcing plate 4, and the grounding conductive portion 6 is formed by this folded back portion. The shielding member 7 is in electrical continuity with the conductor 5.

The housing 10 is made from a synthetic resin molded article, which is formed in the shape of a box having an open front surface side. That is, the housing 10 is constituted by a top surface portion 11, a bottom surface portion 12 and right and left side portions 13, constructed in such a manner that the cable 1 can be inserted through the opening on the front surface side. On the back surface side of the housing 10, multiple terminal holes 14 (FIGS 5-7) are equally spaced laterally from each other and each of the terminals 20 is held in each of the terminal holes 14. Also, within the housing 10, multiple protruding pieces 15 (FIGS. 1, 3, and 5-7), which extend forward from a roughly middle part in the back and forth direction, are equally spaced laterally from each other, and the area between each of the protruding pieces 15 and the bottom surface portion 12 forms a press-fit portion into which part of the shell 30 is to be press fitted.

Each of the terminals 20 is formed from a conductive metal plate and held in each of the terminal holes 14 of the housing 10. Each of the terminals 20 has an elastic piece portion 21 and a fixed piece portion 22 which extend forward as a bifurcation with a vertical gap from each other, and at the tail end of the bifurcation there is provided a board connection portion 23 which is connected to a board not shown in the figures.

The shell 30 is made from a conductive metal, which is formed in the shape of a laterally long annulus so as to cover the top surface, bottom surface and two side surfaces of the housing 10. In this case, the shell 30 is formed by bending an elongated plate-like member in roughly rectangular shape and butting the two ends thereof in the middle part of the bottom surface of the housing 10. The bottom surface side of the shell 30 is formed in such a manner that the parts other than the two ends of the shell 30 in the width direction are positioned a little above the bottom surface of the housing 10, and in multiple places in the width direction of the shell 30 there are provided grounding contact portions 31, which come into contact with the grounding conductive portion 6 of the cable 1. In this case, each of the grounding contact portions 31 is formed by cutting part of the lower surface side of the shell 30 upward, and between the grounding contact portions 31 there is provided a fixed piece 32 which is to be press fitted into the area between each of the protruding pieces 15 and the bottom surface portion 12 of the housing 10. Both ends of the shell 30 in the width direction are each provided with a board connection portion 33 which is connected to a board not shown in the figures.

In a connector constructed as described above, when as shown in FIG. 6, the side of one of the cable 1 is inserted from the front into the housing 10, with one surface of the cable 1 (the surface on the signal-line conductive portion 3 side) facing upward, each of the signal-line conductive portions 3 of the cable 1 comes into contact with the elastic piece portion 21 of each of the terminals 20 and the grounding conductive portion 6 of the cable 1 comes into contact with each of the grounding contact portions 31 of the shell 30. On that occasion, due to pressure contact with the cable 1, each of the elastic piece portions 21 is elastically deformed upward and each of the grounding contact pieces 31 is elastically deformed downward. As a result of this, each of the signal lines of the cable 1 conducts to a signal-line conductive portion (not shown) of the board through each of the terminals 20 and the grounding of the cable 1 is electrically connected to a grounding conductive portion (not shown) of the board through the shell 30. On that occasion, because the top surface, bottom surface and two side surfaces of the housing 10 are covered with the shell 30, the cable 1 within the housing 10 is electrically shielded in any direction of the top surface, bottom surface and two side surfaces of the housing 10.

As described above, according to a connector of this embodiment, the grounding shell 30 is formed so as to cover the top surface, bottom surface and two side surfaces of the housing 10. Therefore, the cable 1 within the housing 10 can be electrically shielded in any direction of the top surface, bottom surface and two side surfaces of the housing 10 and it is possible to significantly improve the effect of preventing electromagnetic interference.

In this case, the top surface side and bottom surface side of the shell 30 are disposed respectively on the top surface side and bottom surface side of the housing 10. Therefore, it is also possible to provide the grounding contact portion 31 on the top surface side of the shell 30, and not on the bottom surface side thereof, and a connector can be easily manufactured, for example, both as a type in which the cable 1 can be inserted with the top surface side up and a type in which the cable 1 can be inserted with the bottom surface side up.

Because grounding contact portions 31 are provided in multiple places in the width direction of the shell 30, it is possible to bring the shell 30 into contact with the grounding conductive portion 6 of the cable 1 in the multiple places and it is possible to cause the grounding conductive portion 6 of the cable 1 and the sell 30 to be positively conducting.

Furthermore, because the grounding contact portion 31 is formed by cutting part of the shell 30 upward, the grounding contact portion 31 can be easily formed in the shell 30 by punching etc. In this case, the grounding contact portion 31 can be brought into pressure contact with the cable 1 by the elasticity of the part which is cut upward, and the reliability of connection of the grounding contact portion 31 to the cable 1 can be increased.

Because the shell 30 is fixed to the housing 10 by press fitting the fixed piece 32 of the shell 30 into the area between each of the protruding piece 15 of the housing 10 and the bottom surface portion 12, the shell 30 can be positively attached to the housing 10 without using a complicated structure and this is structurally very advantageous.

Incidentally, although the case where the flexible flat cable 1 is connected was shown in the above-described embodiment, it is also possible to connect a flexible printed circuit (FPC).

The invention claimed is:

1. A connector for connecting a flexible flat cable or a flexible printed circuit to a circuit board, the flexible cable or flexible printed circuit including plural spaced longitudinal conductors on a first exposed side and a ground conductor on a second exposed side, the connector comprising a housing having a top, a bottom and two sides respectively having exterior top, bottom with a top surface and two side surfaces covered by a grounding and electrically shielding shell, a front side of the housing being open for enabling the flexible cable or flexible printed circuit to be inserted through the front side for respectively engaging elastic contacts on a plurality of terminals, the plurality of terminals being fixedly mounted in side-by-side relation in the housing between the two sides of the housing, each of the terminals including, a portion for connection to the circuit board, the shell including plural, fixed grounding contact portions that are generally coplanar and parallel to interior surfaces of the top and bottom of the housing, adjacent pairs of the plural grounding contact portions having spaced edges that extend in the same direction as the sides of the housing, the housing having plural protruding pieces, each located between one of the contact portions and the interior surface of the top or bottom of the housing, the protruding pieces extending forwardly and backwardly and being generally coplanar and parallel to the interior surfaces of the top and bottom of the housing, the plural, fixed grounding contact portions of the shell being press fit between the protruding pieces and the interior surface of the bottom or top of the housing.

2. The connector according to claim 1, wherein the grounding contact portions are formed by cutting part of the shell upward.

3. The connector of claim 1 wherein the grounding contact portions include portions of the shell that are cut toward the top of the housing.

* * * * *